US008099882B2

(12) United States Patent
Voitchovsky

(10) Patent No.: US 8,099,882 B2
(45) Date of Patent: Jan. 24, 2012

(54) IRON

(75) Inventor: Serge Voitchovsky, Mézières (CH)

(73) Assignee: Laurastar S.A., Chatel-St-Denis (CH)

( * ) Notice: Subject to any disclaimer, the term of this patent is extended or adjusted under 35 U.S.C. 154(b) by 290 days.

(21) Appl. No.: 12/518,514

(22) PCT Filed: Nov. 10, 2007

(86) PCT No.: PCT/IB2007/054574

§ 371 (c)(1),
(2), (4) Date: Jul. 6, 2009

(87) PCT Pub. No.: WO2008/075226

PCT Pub. Date: Jun. 26, 2008

(65) Prior Publication Data

US 2010/0058624 A1 Mar. 11, 2010

(30) Foreign Application Priority Data

Dec. 15, 2006 (EP) ..... 06126287

(51) Int. Cl.
*D06F 75/34* (2006.01)
*D06F 75/24* (2006.01)

(52) U.S. Cl. ..... 38/90; 38/77.7

(58) Field of Classification Search ..... 38/74, 77.83, 38/88, 90, 95, 96; 219/245, 250, 268, 259
See application file for complete search history.

(56) References Cited

U.S. PATENT DOCUMENTS

| | | | | | |
|---|---|---|---|---|---|
| 1,150,431 | A | * | 8/1915 | Heineman | 219/256 |
| 1,231,056 | A | * | 6/1917 | Palmer | 219/257 |
| 1,365,186 | A | | 1/1921 | Balda | |
| 1,458,418 | A | * | 6/1923 | Johnston et al. | 200/61.05 |
| 2,072,217 | A | * | 3/1937 | Reed | 38/79 |
| 2,736,789 | A | * | 2/1956 | Cornellier | 38/82 |
| 3,094,798 | A | * | 6/1963 | Turner | 38/95 |
| 4,745,260 | A | * | 5/1988 | Albinger et al. | 219/250 |
| 6,307,182 | B1 | | 10/2001 | Lile | |
| 2003/0056408 | A1 | * | 3/2003 | Hecht | 38/96 |

FOREIGN PATENT DOCUMENTS

| | | |
|---|---|---|
| EP | 0 390 264 | 10/1990 |
| EP | 0 433 785 | 6/1991 |
| EP | 0 750 066 | 11/2000 |
| EP | 1 690 978 | 8/2006 |
| WO | WO 2004/009898 | 1/2004 |
| WO | WO 2007/148349 | 12/2007 |

OTHER PUBLICATIONS

English Translation of International Search Report for PCT/IB2007/054574, mailed May 13, 2008.

* cited by examiner

*Primary Examiner* — Ismael Izaguirre
(74) *Attorney, Agent, or Firm* — Nixon & Vanderhye P.C.

(57) ABSTRACT

The invention relates to an iron (1) having a sole (2) on top of which is formed a body (3, 5) defining a handle and a sleeve (4), said body (3, 5) including at least one switch (7, 9) associated with a function such as steam generation, characterised in that the sleeve (4) is mounted so as to be capable of movement relative to the body (3, 5) and in that the switch (7, 9) can be actuated by a mechanical member (10, 14) secured to the sleeve (4).

8 Claims, 2 Drawing Sheets

IRON

Figure 1:
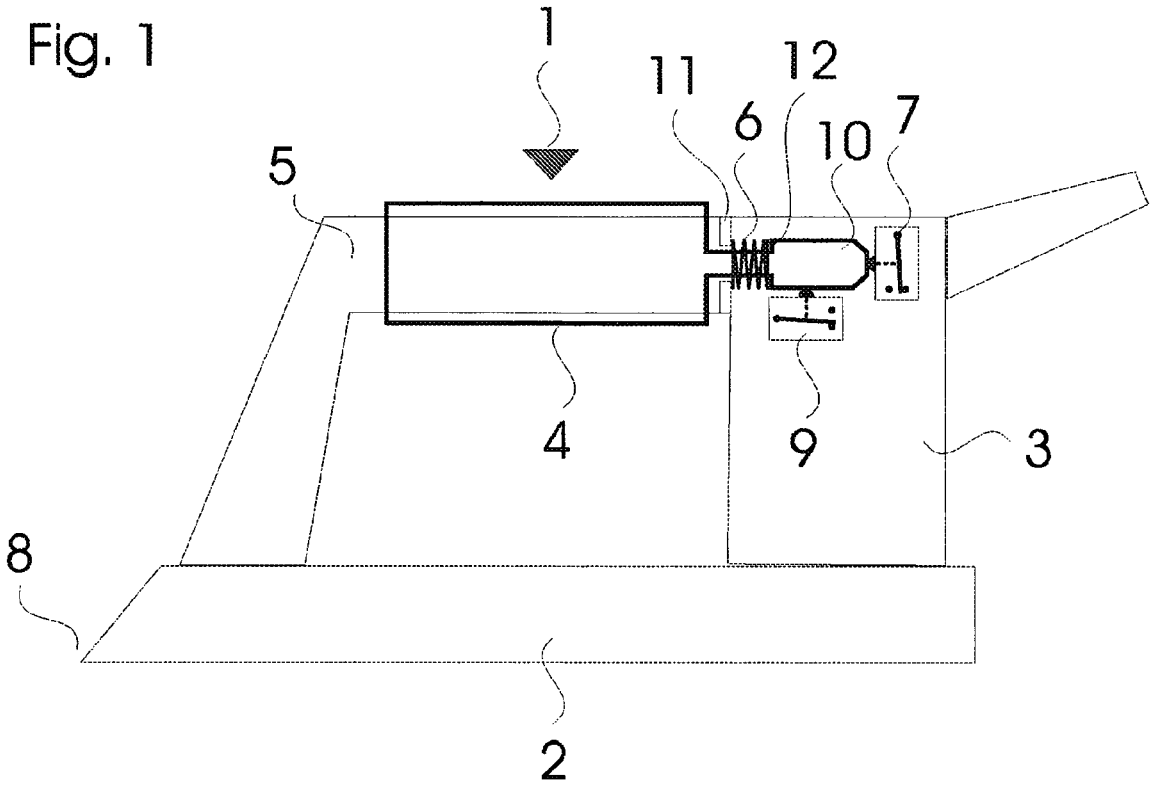

This application is the U.S. national phase of International Application No. PCT/IB2007/054574, filed 10 Nov. 2007, which designated the U.S. and claims priority to Europe Application No. 06126287.9 filed 15 Dec. 2006, the entire contents of each of which are hereby incorporated by reference.

FIELD OF THE INVENTION

The invention lies in the field of ironing, and more precisely in that of irons that comprise at least one switch associated with an operation such as steam generation or blowing/suction at the level of the ironing board.

THE PRIOR ART

An ironing system such as previously described is described in European patent EP 0 750 066 B1.

Moreover, irons equipped with sensors enabling the detection of diverse parameters are known. By way of example, it is possible to mention European patent application EP 0 390 264 A1, which describes a motion detector. When this is deactivated, i.e. when the iron is at rest, steam production ceases.

European patent applications EP 0 433 785 A1 and EP 1 690 878 A1 also describe irons equipped with sensors which trigger an operation when they are activated.

Ironing systems equipped with sensors have the advantage of automating some operations.

However, disadvantages result from the use of such systems.

The use of sensors has the effect of making the assembly of the ironing system more complicated, therefore less reliable, less precise, slower and more costly.

U.S. Pat. No. 1,365,186 describes a sensorless system in which the entire handle is made movable relative to the rest of the iron. Depending on the position of the handle, the iron may stop operating.

This mechanism is, however, complicated. In addition, the fact that the entire handle is made movable causes discomfort for the user.

A need therefore exists to improve the ironing systems of the prior art, in particular the systems provided with operations that can be automatically activated.

GENERAL DESCRIPTION OF THE INVENTION

One of the objectives that the present invention proposes to attain consists in eliminating sensors for automating some operations.

Another objective consists in offering a simplified mechanism for activating operations.

Another objective consists in making the handling of the iron more pleasant.

The iron according to the invention comprises a soleplate mounted over a body forming the handle, the body comprising at least one switch associated with an operation such as steam generation. The iron according to the invention is characterized by the fact that it comprises a sleeve designed to be gripped by the user, the sleeve being mounted in a movable manner relative to the body, the switch being made activable by means of a mechanical element joined to the handle.

"Activation of the switch" is understood to mean a change in the state of the switch which has the effect of activating or deactivating an operation such as the release of steam or the start of ventilation.

Thus it suffices to perform a relative movement of the sleeve relative to the body for the operation associated with the switch to be able to be instantly activated or deactivated.

The iron according to the invention has several advantages, in particular:

robust and simple production;

increased reliability;

low component cost;

handle free of a push button.

In one embodiment of the invention, the sleeve is mounted to slide relative to the body, in a direction substantially parallel to the plane defined by the soleplate. A simple way of producing this variant consists in using a body that comprises a horizontal portion around which the sleeve is able to slide.

Alternatively or in addition to the variant below, the sleeve is made movable relative to the body in a direction substantially perpendicular to the plane defined by the soleplate.

One exemplary embodiment of this variant consists in equipping the body with two vertical guides in which the ends of the sleeve can move.

Another exemplary embodiment consists of using a pivoting mechanical element. When the iron is lifted, the mechanical element pivots and one of its ends activates a switch.

In another embodiment, the iron comprises two switches, the first switch being able to be activated by movement of the sleeve in a direction substantially parallel to the plane defined by the soleplate, the second switch being able to be activated by movement of the sleeve in a direction substantially perpendicular to the plane defined by the soleplate.

Advantageously, when the sleeve moves in a plane substantially parallel to that defined by the soleplate, the iron comprises return means designed to restore the sleeve to a basic position when the iron is at rest.

Return means may also be used to restore the sleeve to a basic position when this moves vertically.

The invention also relates to an ironing system comprising an iron such as that previously defined and steam generation means, characterized by the fact that the steam generation means can be activated when the sleeve moves towards the front of the iron.

This system may also comprise means for activating another operation, for example a blowing/suction system, characterized by the fact that the means for activating said other operation can be activated when the sleeve moves in the opposite direction to the soleplate.

Alternatively, these means may be activated when the sleeve moves in the direction of the soleplate.

According to another variant, the steam generation means can be activated when the sleeve moves in the direction of the soleplate.

Obviously, any other operation may be used in the scope of the present invention in place of or in addition to the aforementioned operations. By way of example, heating of the iron may be mentioned.

As has been seen, the invention is characterized by the absence of sensors for carrying out certain operations. It is, however, possible to use sensors, but for carrying out other operations.

DETAILED DESCRIPTION OF THE INVENTION

Figure 2:
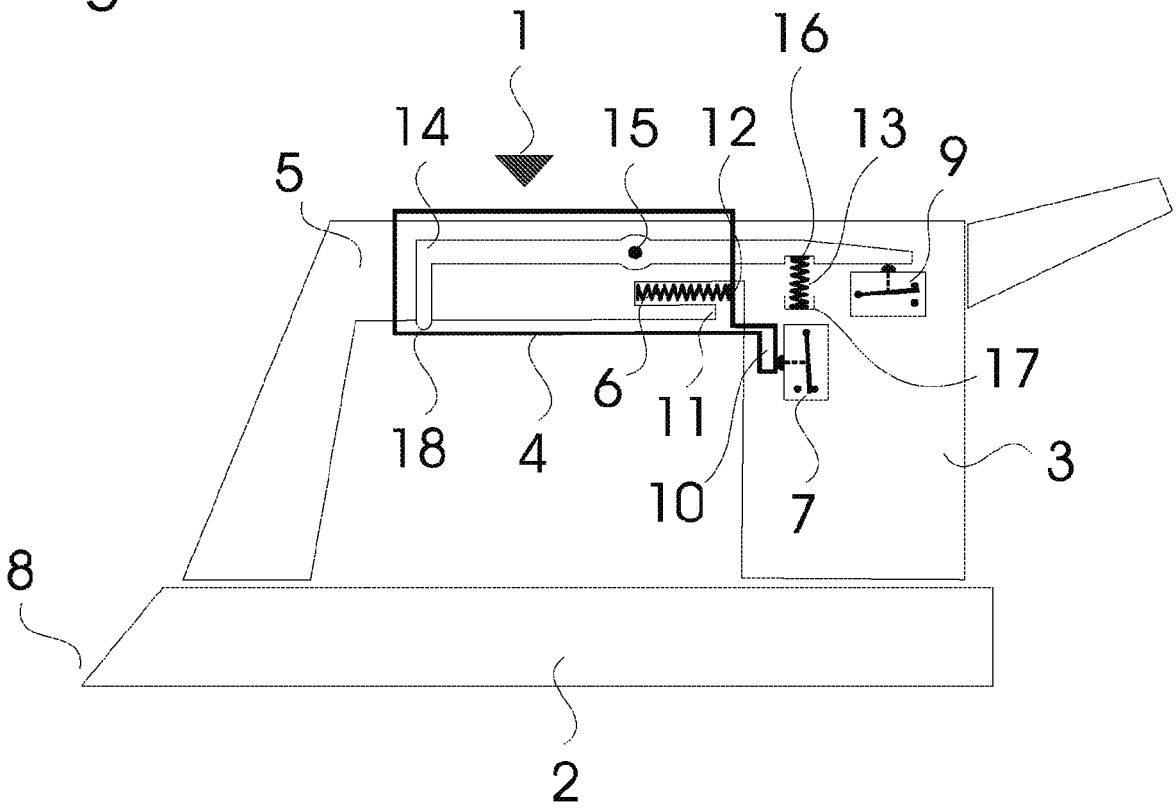

The invention is described in greater detail below using examples illustrated by the following figures:

FIG. 1 schematically describes a first embodiment of an iron according to the invention; and FIG. 2 schematically describes a second embodiment of an iron according to the invention.

The iron 1 illustrated in FIG. 1 consists of a soleplate 2 mounted over a body 3, 5 forming the handle. A sleeve 4 is mounted so as to slide around the horizontal part of the body 3, 5.

A mechanical element 10 in the form of a rod is attached to the rear end of the sleeve 4 and extends in the same direction as this.

The travel of the mechanical element 10, and hence of the sleeve 4, is limited in a forward direction by a stop 11 which holds an element 12 for retaining the mechanical element 10.

Return means 6, a spring in the present case, are positioned around the mechanical element 10, between the stop 11 and the retaining element 12, in such a way that a return force is exerted on the sleeve 4 when this moves towards the front of the iron 1.

Thus, when the iron 1 is moved in the direction of the tip 8, the mechanical element 10 moves and compresses the spring 6. And when the iron 1 is moved back or the sleeve 4 released, the spring 6 pushes the sleeve 4 back into its initial position.

The rear part of the body 3 comprises a switch 7 positioned in line with the mechanical element 10. The switch 7 is schematically represented by a lever that is able to move between a rest position (that which is illustrated in FIG. 1) and a position called the active position when the sleeve 4 moves in the direction of the tip 8.

According to another non-illustrated variant, the switch 7 is connected to the solenoid valve of a steam generator in such a way that the steam is released when the sleeve 4 moves forwards. When the sleeve 4 returns to its rest position, the steam ceases.

FIG. 1 also schematically, but partially, illustrates the possibility of moving the sleeve 4 in the opposite direction to the soleplate 2. A second switch 9 is positioned below the mechanical element 10. The second switch 9 may, for example, be connected to the fan of an ironing board. When the iron 1 is lifted, the vertical movement of the sleeve 4 relative to the body 3 activates the second switch 9 and the fan is started.

FIG. 2 presents a variant of the invention, fairly similar to the preceding variant with regard to the horizontal movement of the sleeve 4, but which differs in that the mechanical element 10 is in the shape of a right angle.

The return means 6 are positioned at the center of the sleeve 4 in such a way that a return force is exerted on the sleeve 4 when this moves towards the front of the iron 1.

In contrast to the embodiment of FIG. 1, the switch 7 is not positioned in line with the sleeve 4, but below it.

FIG. 2 also schematically illustrates the possibility of moving the sleeve 4 in the opposite direction to the soleplate 2, but in a different manner from the embodiment of FIG. 1. A second switch 9 is positioned in the rear part of the body 3, below a second mechanical element 14. The second switch 9 may, for example, be connected to the fan of an ironing board. When the iron 1 is lifted, the movement in the opposite direction to the soleplate 2 of the sleeve 4 relative to the body 5 pushes the end 18 of the second mechanical element 14 in the opposite direction to the soleplate 2. The mechanical element 14 pivots about its midpoint 15, which is fixed, compresses the return means 13 (a spring in the present case), and activates the second switch 9, which has the effect of starting the operation, for example a fan.

It is obvious that the invention is not limited to the examples presented above.

In particular, the mechanism for activating a switch according to the invention may be applied to any operation at all (steam generation, heating, blowing, suction, etc.).

The invention claimed is:

1. An iron comprising:

a soleplate mounted over a body forming a handle, a sleeve, a first switch, and a second switch, wherein said body comprises the first switch that is associated with an operation, wherein the sleeve is mounted in a movable manner relative to the body and in that the first switch is activated by means of a mechanical element joined to the sleeve, and wherein the first switch is activated by movement of the sleeve in a direction substantially parallel to the plane defined by the soleplate, and the second switch is activated by movement of the sleeve in a direction substantially perpendicular to the plane defined by the soleplate.

2. The iron as claimed in claim 1, in which the sleeve is mounted to slide relative to the body, in a direction substantially parallel to the plane defined by the soleplate.

3. The iron as claimed in claim 1, in which the sleeve is movable relative to the body in a direction substantially perpendicular to the plane defined by the soleplate.

4. The iron as claimed in claim 1, comprising return means designed to restore the sleeve to a basic position when the iron is at rest.

5. An ironing system comprising an iron as claimed in claim 1 and steam generation means, wherein the steam generation means is activated when the sleeve moves towards the front of the iron.

6. The ironing system as claimed in claim 5, further comprising means for activating another operation, wherein the means for activating said another operation is activated when the sleeve moves in the opposite direction to the soleplate.

7. The iron as claimed in claim 1, wherein the operation is steam generation.

8. The ironing system as claimed in claim 6, wherein said another operation is a blowing/suction system.

* * * * *